United States Patent [19]

Darecchio

[11] Patent Number: 4,641,487

[45] Date of Patent: Feb. 10, 1987

[54] MACHINE AND METHOD FOR CUTTING, SHAPING AND CANNING MEAT, FISH AND THE LIKE

[75] Inventor: Andrea Darecchio, Parma, Italy

[73] Assignee: FMC Corporation, Chicago, Ill.

[21] Appl. No.: 784,424

[22] Filed: Oct. 4, 1985

[30] Foreign Application Priority Data

Oct. 18, 1984 [IT] Italy ..... 23219 A/84

[51] Int. Cl.[4] ..... B65B 63/00

[52] U.S. Cl. ..... 53/435; 53/438; 53/517; 53/513; 53/529

[58] Field of Search ..... 53/122, 513, 514, 516, 53/517, 529, 435, 436, 438; 17/32, 55; 83/123, 124, 125, 126, 127, 128

[56] References Cited

U.S. PATENT DOCUMENTS

| | | | |
|---|---|---|---|
| 2,926,095 | 2/1960 | Gorby | 53/517 X |
| 3,179,041 | 4/1965 | Luthi et al. | 53/517 X |
| 3,273,300 | 9/1966 | Watrous et al. | 53/516 X |
| 3,513,626 | 5/1970 | Zhavoronkova et al. | 53/517 |
| 3,526,077 | 9/1970 | Mixon | 53/517 |
| 3,570,213 | 3/1971 | Sada | 53/517 |
| 3,700,386 | 10/1972 | Menacci | 53/517 X |
| 3,780,490 | 12/1973 | Schack et al. | 53/122 |
| 4,116,600 | 9/1978 | Dutton et al. | 53/517 X |

*Primary Examiner*—Robert L. Spruill
*Assistant Examiner*—Steven P. Weihrouch
*Attorney, Agent, or Firm*—Louis J. Pizzanelli; Richard B. Megley

[57] ABSTRACT

A machine is disclosed for canning meat, tuna fish and the like and in particular a device for cutting and shaping the slices as well as their insertion in cans. The device comprises essentially means for feeding the meat vertically to a horizontal shaping channel wherein the meat is pressed by a compactor against a suitably lobed end of the channel, each lobe being provided with a passage bore inside which runs a die that cuts a cylindrical pellet of meat which is pushed into a can lying underneath, through a gate placed under said bore, by a piston running inside the die. The empty cans are brought under the passage bore by a rotating horizontal star shaped plate which simultaneously discharges the filled cans laterally.

2 Claims, 4 Drawing Figures

MACHINE AND METHOD FOR CUTTING, SHAPING AND CANNING MEAT, FISH AND THE LIKE

BACKGROUND OF THE INVENTION

1. Field of the Invention

The present invention relates to apparatus and method plants for canning products such as meat, fish and the like and particularly to a machine that shear the product according to a predetermined orientation of the fibers, to successively compact the slices, to cut them into cylindrical pieces and to transfer them inside cans or other suitable containers. Because of these characteristics, the disclosed machine will be described in connection with canning of tuna fish.

2. Discussion of the Prior Art

It is known that the canning of meat, fish and the like is an operation that presents significant problems due to the fact that the starting materials have varied shapes, dimensions and densities, while the material introduced in each can must have substantially constant weight and a compact, homogeneous and non crumby testure. Machines presently in use, such as a machine of the type disclosed in Italian Patent No. 794,113 while giving good results, does not avoid completely the problems associated with the canning of the above mentioned products and in particular those problems associated with losses of product, its crumbly texture and relatively slow cycle speed.

SUMMARY OF THE INVENTION

It is, therefore, an object of the present invention to provide a machine wherein the slices of product (i.e. tuna fish) obtained by shearing the chunks fed to the machine are compacted at a constant pressure in order to obtain substantially uniform texture and density while maintaining a desired orientation of the fibers of the product.

Another object of the present invention is to provide a machine wherein cylindrical pieces of product are transferred into appropriate containers along enclosed paths to avoid or minimize loss of product.

A further object of the present invention is to provide a machine having a working speed significantly higher than that of known machines.

These objects are achieved by the disclosed machine which comprises means for feeding chunks of the product to be canned vertically downward to a horizontal shaping channel wherein each sheared slice of product (i.e. tuna fish) is pressed by a compactor against a lobed end of the channel, each lobe being provided with a passage in which a die cuts a cylindrical piece and pushes it inside a can lying underneath through a gate disposed under said bore by a piston running inside the die. The empty cans are supplied by a rotating plate that concurrently transfers filled cans.

The machine in accordance with the present invention offers the additional advantage that tuna fish may be gravity fed through a simple tube thus significantly reducing the processing noise by obviating use of pneumatic actuator needed to insert the cylindrical piece of fish in a can.

Further in accordance with the present invention, dies that cut and shape the cylindrical pieces of tuna fish, reach well inside the respective cans underneath so that the risk of loosing particles of product during the canning process is substantially eliminated. The piston acts on the tuna piece only when it is inside the can.

Another advantage of the machine in accordance with the present invention is that reduction of the noise level is achieved since clashing of empty cans is avoided.

A further advantage offered by the machine according to the present invention is that integration with downstream machines are simpler.

DESCRIPTION OF THE PREFERRED EMBODIMENT

Figure 1:
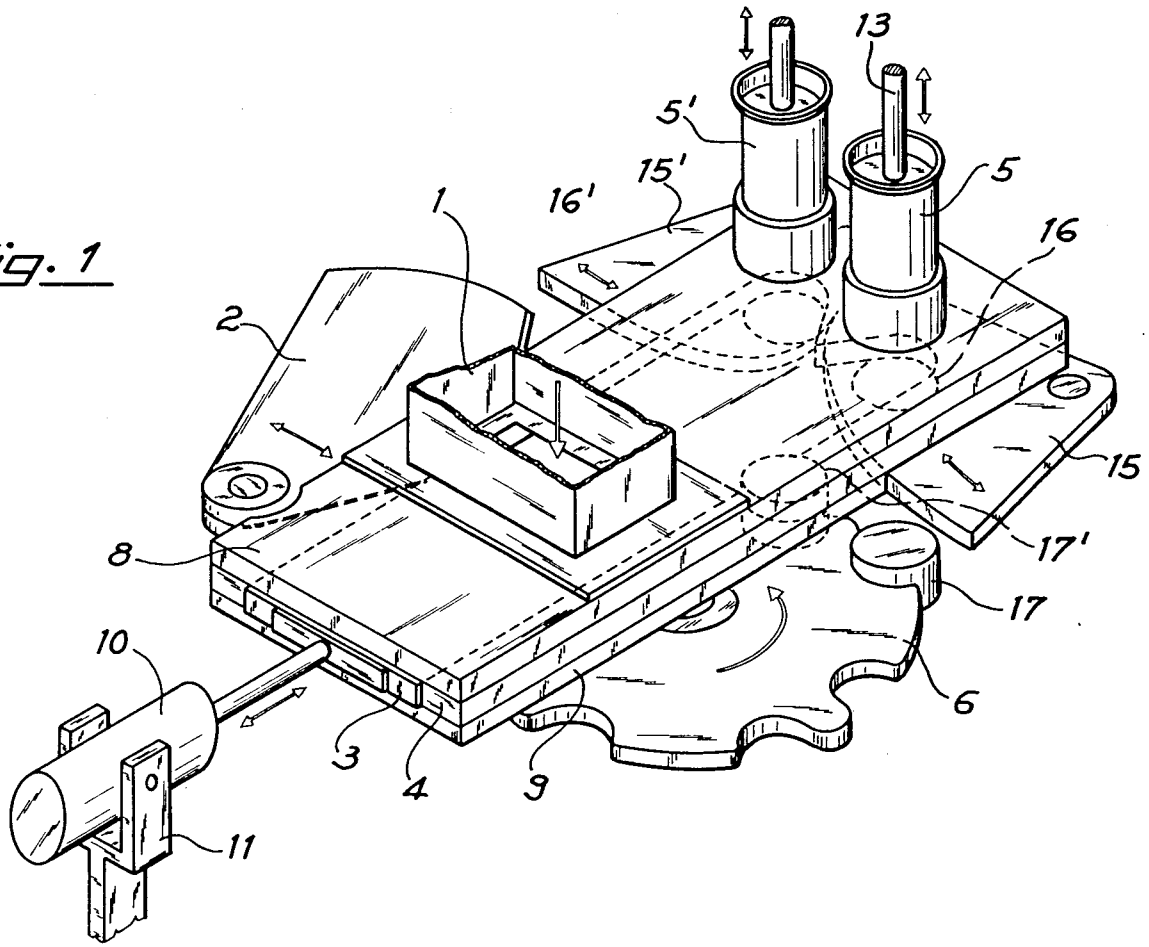
FIG. 1 shows a schematic general view of a machine according to the present invention.

The invention, its objects and advantages will evident to those skilled in the art by the detailed description of the presently preferred embodiment. With reference to FIG. 1, it is observed that the machine comprises a feeder 1, a shearing device 2, product compacting means 3 and 4 for shaping the product, means 5 and 5', for cutting the cylindrical pieces and inserting them into the containers 17 and a device 6 for feeding and removing the containers. The product supplied by feeder 1 is sheared by the device 2 and the slice thus obtained is pushed by the compactor 3 in the shaping channel 4 provided at the other end with two lobes through which the dies 5 and 5' slide vertically and cut the cylindrical pellets of product that are thence inserted into the cans 17 underneath which are supplied by the device 6.

Figure 2:
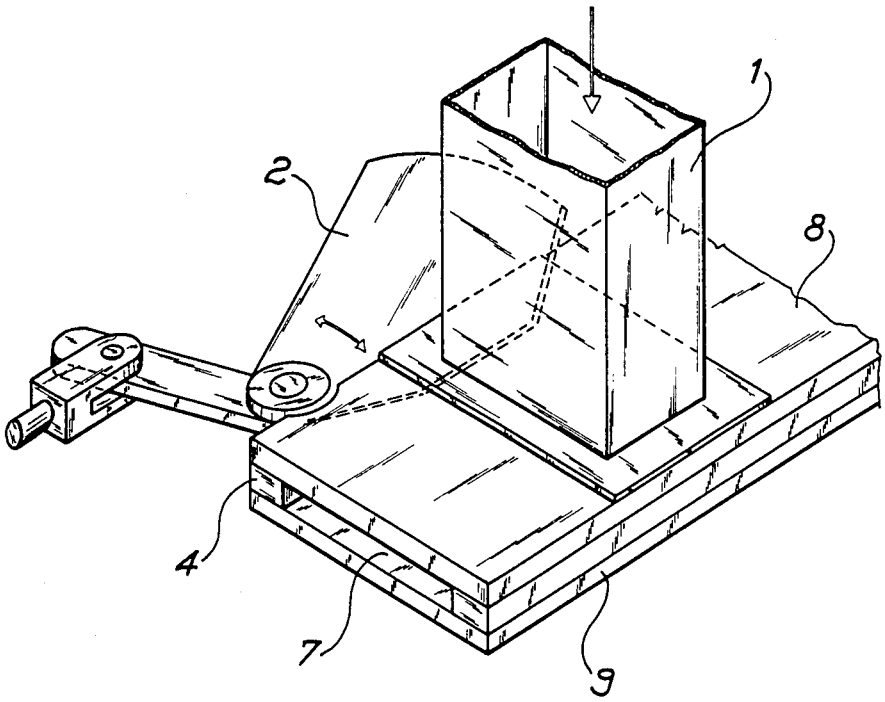
FIG. 2 shows a detailed view of the means for feeding and cutting the product.

Making reference to FIG. 2 it is observed that the feeder 1 is made in the form of a prismatic channel into which the product (i.e. chunks of tuna fish) to be canned may be introduced manually. The product may be transferred to the feeder 1 also by means of a conveyor or other suitable means. The vertical supply of the product is one of the advantageous characteristics of the machine according to the present invention. With such an orientation it is possible to place and maintain, in a vertical direction, the fibers of the product to be canned. The product falls by gravity until it reaches the bottom of the parallelepiped channel 7 the height of which corresponds to the predetermined thickness of the cylindrical piece of product going in a can 17. The parallelepiped channel 7 is closed at the top by plate 8 and at the bottom by plate 9 while closing of the slides and of the end is provided by a two-lobed shaper 4 (FIG. 3) which also acts as a spacer between the top plate 8 and the bottom plate 9 determining the thickness of the slices of product.

Referring again to FIG. 2 it is observed that the device to shear the product inside the channel 7 comprises an rotating blade 2. Conventional mechanical linkages which may be operated by a pneumatic linear actuator oscillate the blade 2 in an included angle of about 60°. In the course of oscillation the blade 2 crosses the lower mouth of feeder 1 by passing through a suitable slot provided in the plate 8. As the blade 2 moves across the feeder 1, a slice of a product of thickness equal to the height of channel 7 is produced, and as the knife begins its return stroke at the end of which the blade reaches a position such that the blade itself closes the slot in plate 8 thus sealing channel 7. Knife 2 shears the fibers of the product perpendicularly to the direction of their vertical orientation thereby producing a high quality pack.

Figure 3:
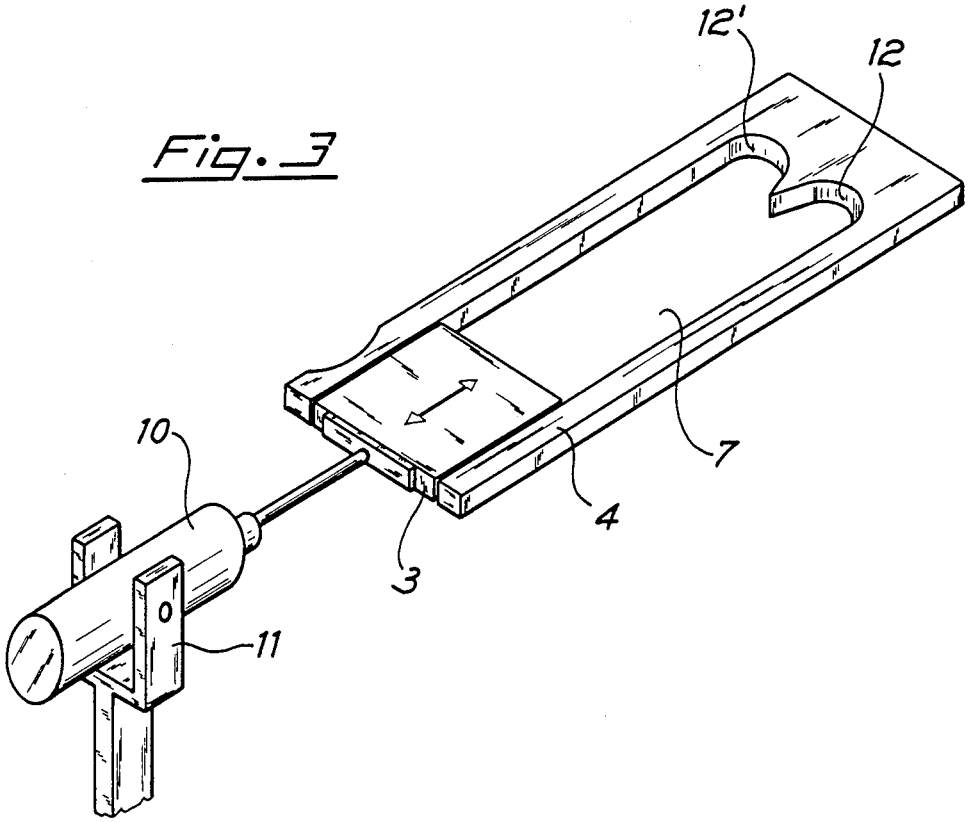
FIG. 3 shows a detailed view of the means for compacting and shaping the pieces of product.

Making reference to FIG. 3 illustrates the system for forming the cylindrical pieces of product to be canned. The system comprises a reciprocating compactor 3 moveable toward and away adjacent semi circular surfaces 12 and 12' formed at one extremity of shaping plate. Shaping plate 4 includes a channel 7 which is closed above and below by the plates 8 and 9. The compactor 3 is reciprocated by a conventional linear pneumatic actuator 10 pivotally supported by lever 11. The head end of the actuator 10 is directly connected to a source of pressure air constant pressure, while the rod end is vented. in this way, actuator 10 exerts a constant force.

In its motion toward surfaces 12 and 12' of the shaping plate 4, compactor 3 pushes a slice of product inside the channel 7 and compresses it against the lobes. Such compression produces a homogeneous distribution of the product inside the space defined by the surfaces 12 and 12' thus tending to form a pack of uniform density. As a result uniform density of pack which fulfills desired weight.

Figure 4:
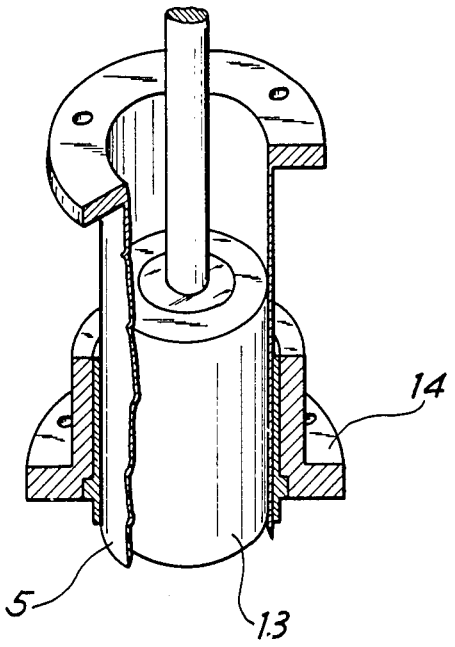
FIG. 4 shows in detail means for the cutting the cylindrical pieces of product and their insertion in a can or other suitable container.

Making reference to FIG. 4 it is observed that the device for cutting cylindrical pieces of product comprises a die 5 in which a piston 13 is slidably disposed runs. Both the die 5 and the piston 13 are vertically reciprocable. Die 5 is aligned with the vertical axis of lobe 12 by means of a flange 14, fixed on the plate 8 defining, at the top, the shaping channel 7. Plate 8 is provided with a cylindrical bore through which the die 5 may pass to make contact with support surface 15 and 15' shown in FIG. 1. The support surfaces 15 and 15' are pivoted to the position shown in FIG. 1 when the product is being cut and then pivoted laterally outwardly.

Referring now to FIG. 1 it will be observed that, once the cylindrical pellet of product has been cut, the stopper 15 rotates laterally in order to bring its circular bore 16 in communication with the lobe 12. In that way the die 5 is free to move along its downward stroke until it reaches inside the can 17. When the die has reached the inside of the can 17, the piston 13 acts and pushes the pellet of product inside the can 17 thus filling it. The internal diameter of the can 17 is slightly bigger that the external diameter of the die 5. Therefore the die 5 acts as a guide for the pellet of product during its transfer from the shaping channel 7 into the can 17 preventing any spilling or crumbling of product. At this point all the organs of the machine return to their initial position ready for the following cycle.

Simultaneously the star shaped disc 6 rotates by 90° transferring the two filled cans to an outgoing conveyor (not shown) placed laterally and positioning under the dies 5 and 5' two empty cans coming from an ingoing conveyor (not shown).

As it is seen in FIG. 1, the two-lobed end of the channel 7 allows the simultaneous utilization of the two dies 5 and 5', that makes possible the filling of two cans 17 and 17' for each working cycle thus doubling the working capacity of the machine which may reach, in this way, the level of three hundreds containers per minute. It is obvious that by increasing the number of co-operating lobed and dies the working capacity of the machine may be further increased. Moreover cutting and retaining the cut product within the die 5 confines the partion to be packaged so that it inserting in the package occurs without the creation slivers of product.

Although the best mode contemplated for carrying out the present invention has been shown and described, it will be apparent that modifications and variations may be made without departing from what is regarded to be the subject matter of the invention.

What is claimed is:

1. A method of packaging sliced meat products such as fish comprising the steps of confining the slices in a cavity formed with wall portions corresponding to the configuration of a portion of the package, compressing the slices to make intimate and forceable contact with the walls of the cavity, said compression being effective to compact the slice sufficiently to achieve a substantially consistent density, cutting the compressed slice with a hollow cutter having a peripheral cutting edge shaped to conform with the shape of the package and concurrently retaining the cut slice in the hollow portion of the cutter, opening the cavity and positioning a package in the projected area of the cutter at the cavity opening, moving the cutter retaining the cut slice into the package, and displacing the cut slice relative to the cutter and into the package and while withdrawing the cutter therefrom.

2. An apparatus for packing sliced meat products such as fish comprising a cavity formed with wall portions corresponding to the configuration of a portion of a package for receiving slices of the product, means for compressing the slices residing in the cavity so that intimate contact with the cavity walls is achieved to produce a substantially consistent density, means for cutting the compressed slice in a shape corresponding to the shape of the package, said cutting means being a tubular cutter that retains the cut slice therein, said cavity comprising a selectively moveable wall located in opposed relation to said tubular cutter, means for moving said wall to open the cavity, means for positioning a package externally of said cavity and in alignment with said tubular cutter, means for displacing said tubular cutter carrying the slice of product into the aligned package, and means for displacing the slice relative to the tubular cutter and into the package during withdrawal of the tubular cutter from the package.

* * * * *